US007480211B2

(12) United States Patent
Golay

(10) Patent No.: US 7,480,211 B2
(45) Date of Patent: Jan. 20, 2009

(54) SECULAR PERPETUAL CALENDAR

(75) Inventor: Pierre-Michel Golay, Prangins (CH)

(73) Assignee: Franck Müler Watchland S.A. (CH)

( * ) Notice: Subject to any disclaimer, the term of this patent is extended or adjusted under 35 U.S.C. 154(b) by 7 days.

(21) Appl. No.: 11/674,725

(22) Filed: Feb. 14, 2007

(65) Prior Publication Data

US 2007/0189122 A1 Aug. 16, 2007

(30) Foreign Application Priority Data

Feb. 14, 2006 (CH) ..... 0233/06

(51) Int. Cl.
*G04B 19/20* (2006.01)
*G04B 19/24* (2006.01)

(52) U.S. Cl. ..... 368/28; 368/37

(58) Field of Classification Search ..... 368/28, 368/35–38

See application file for complete search history.

(56) References Cited

U.S. PATENT DOCUMENTS 2,532,984 A * 12/1950 Avedikian et al. ..... 40/115
3,681,913 A * 8/1972 Solari ..... 368/37
4,031,642 A * 6/1977 Aoki et al. ..... 40/111
4,674,889 A * 6/1987 Klaus ..... 368/28
7,266,050 B2 * 9/2007 Eisenegger et al. ..... 368/37
2005/0232085 A1 * 10/2005 Scheufele ..... 368/37

* cited by examiner

*Primary Examiner*—Vit W Miska
(74) *Attorney, Agent, or Firm*—Ostrolenk, Faber, Gerb & Soffen, LLP

(57) ABSTRACT

The secular perpetual calendar comprises an additional mechanism (4 to 13) integrated in a conventional perpetual calendar mechanism comprising a last wheel (13) making one revolution in 400 years, this wheel (13) carrying a cam (13') of which the steps cooperate with a lever (9) on which pivots a wheel (6) which carries a satellite (7') on which is attached the February cam (7) and the cam (13'), which makes one quarter turn every century, presenting three low steps enabling the lever (9) to move back in such a way that the cam (7) on which the multiple lever (2) will press is in the same position as for a conventional 28-day month of February three times in succession for the years 2100, 2200 and 2300, and then a high step to restore the 29$^{th}$ of February of the year 2400.

2 Claims, 7 Drawing Sheets

SECULAR PERPETUAL CALENDAR

Figure 1:
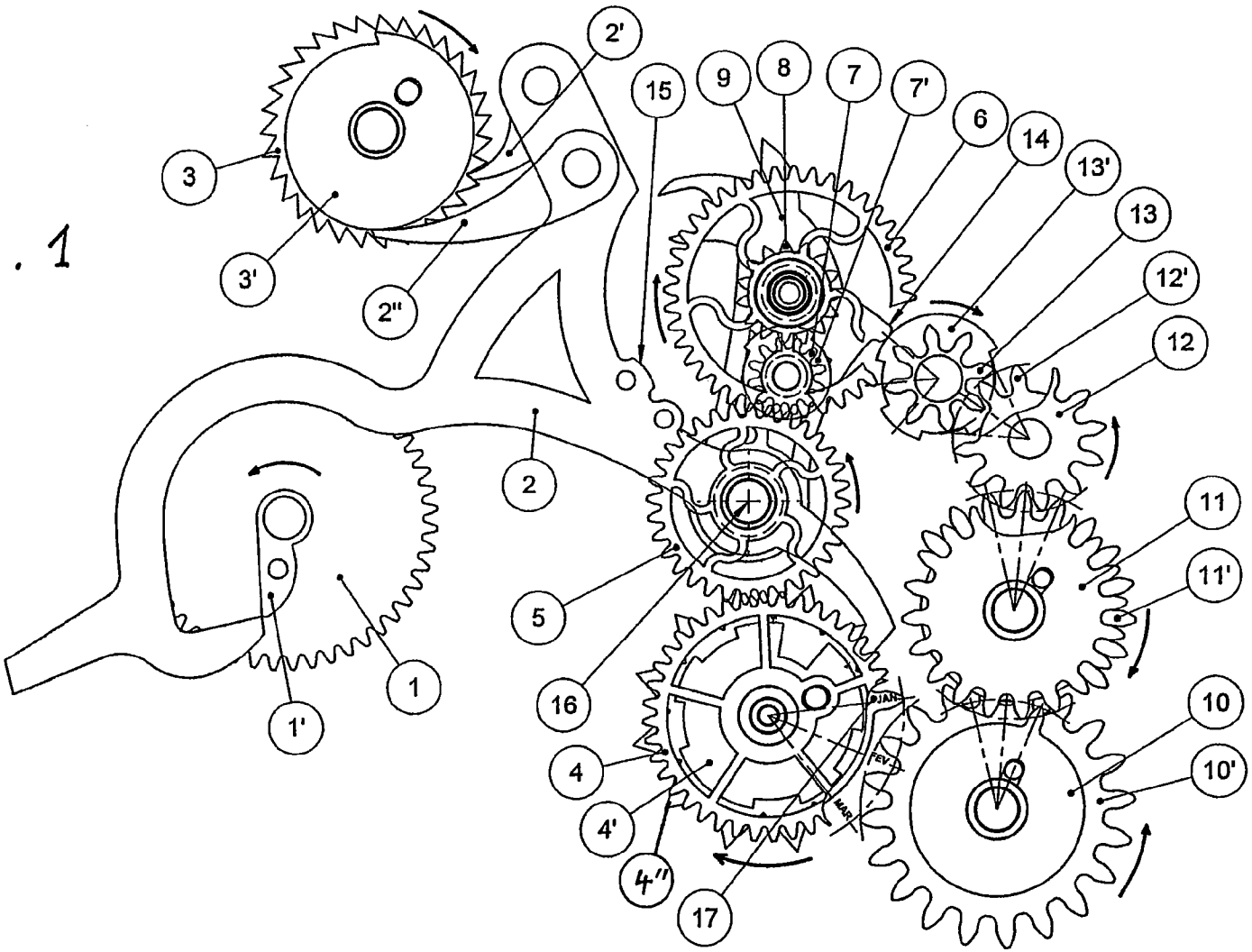

The object of the invention is a secular perpetual calendar for timepieces, especially for wristwatches.

A search conducted by the holder has identified the following two priorities:

Swiss patent no. 653 841 and German patent DE-31294. These two patents describe secular perpetual calendars and represent the state of the technique.

The mechanism described in German patent number 31294 is intended rather to be used in a clock and its use in a wristwatch is unrealistic. However, Swiss patent number 653 841 in the name of Pateck Philips SA describes a more sophisticated mechanism. In this mechanism, the gear train which cooperates with the secular cam is driven in rotation by the month cam at a rate of one revolution in one hundred years. On this gear train making one revolution in one hundred years is mounted a satellite with four branches which makes one quarter turn every one hundred years. This satellite takes the form of a Maltese cross, which can cause some problems in functioning.

The purpose of this invention is to propose a secular perpetual calendar of which the secular gear train carrying the cam is designed to make one revolution every four hundred years.

The secular perpetual calendar for timepieces, especially for wristwatches, according to the invention, comprising a conventional retrograde perpetual calendar mechanism, is characterised in that an additional mechanism is linked to the conventional perpetual calendar mechanism and comprises a last wheel making one revolution in four hundred years, this wheel carrying a cam of which the steps cooperate with a lever on which pivots a wheel which carries a satellite on which is attached the February cam and the cam which makes one quarter turn every century presenting three low steps enabling the lever to move back in such a way that the cam on which the multiple lever will press is in the same position as for a conventional 28-day month of February three times in succession for the years 2100, 2200 and 2300, and then a high step to restore the $29^{th}$ of February of the year 2400. When the wristwatch comprising the secular perpetual calendar is marketed shortly, the secular calendar mechanism will consequently make its first correction in 2400.

According to a preferred mode of execution, a wheel meshing with the wheel making one revolution every four hundred years has a double pin of which the function is to restore, after the month of February of the centenary year, the normal rhythm of the calendar for the next 99 years by causing the four hundred year wheel, and therefore the cam attached on this wheel, to advance by one eighth of a turn.

A feeler of a lever presses on the cam linked to the four hundred year wheel in such a way as to modify its angular position and, consequently, during each month of February, correct or not, depending on whether or not the year is the last year of the century, the number of days in the month in accordance with the position of the cam attached to the wheel (13).

The drawing represents, as an example, a mode of execution of the secular perpetual calendar which is the object of the invention.

Figure 2:
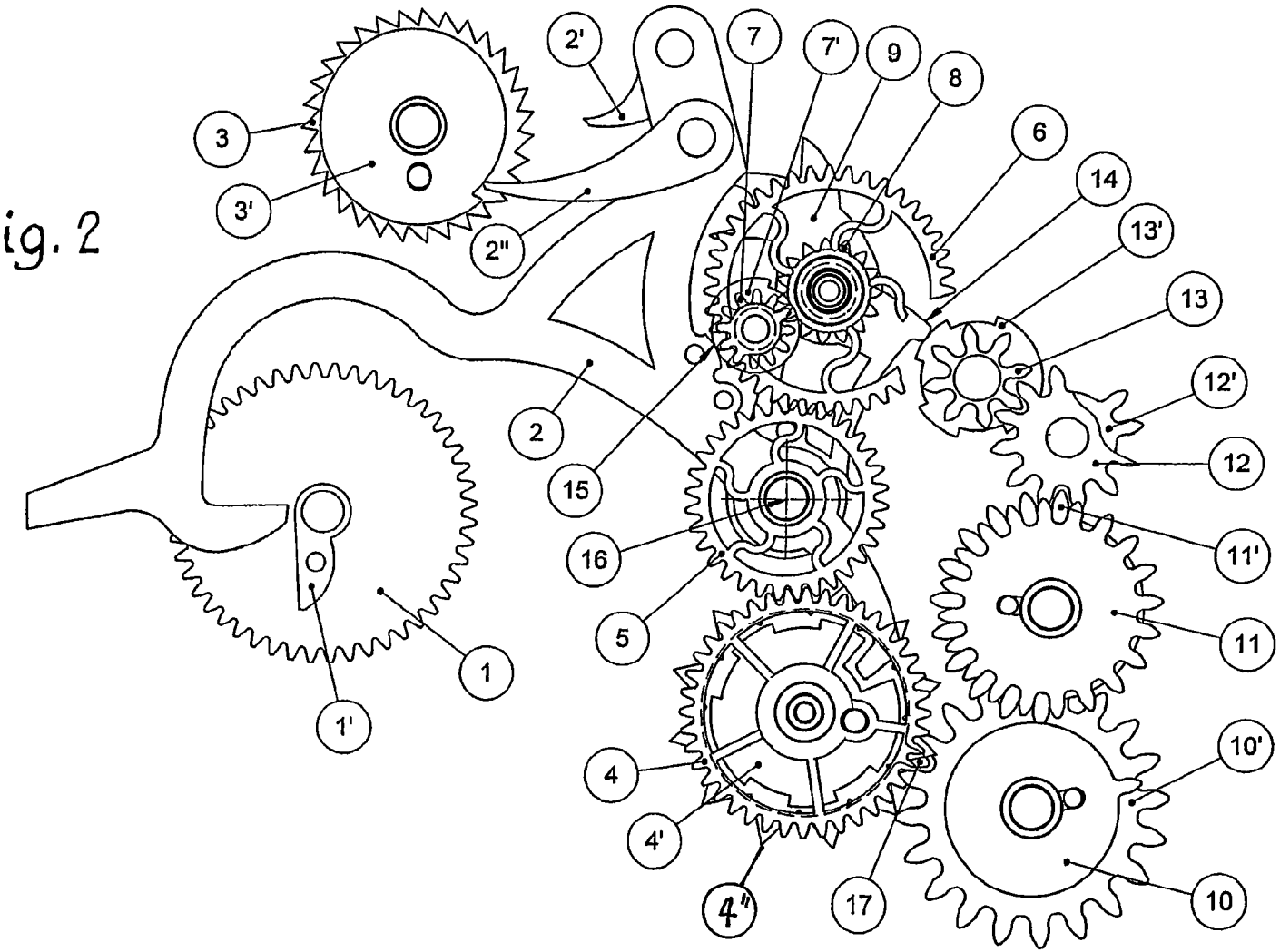
Figure 3:
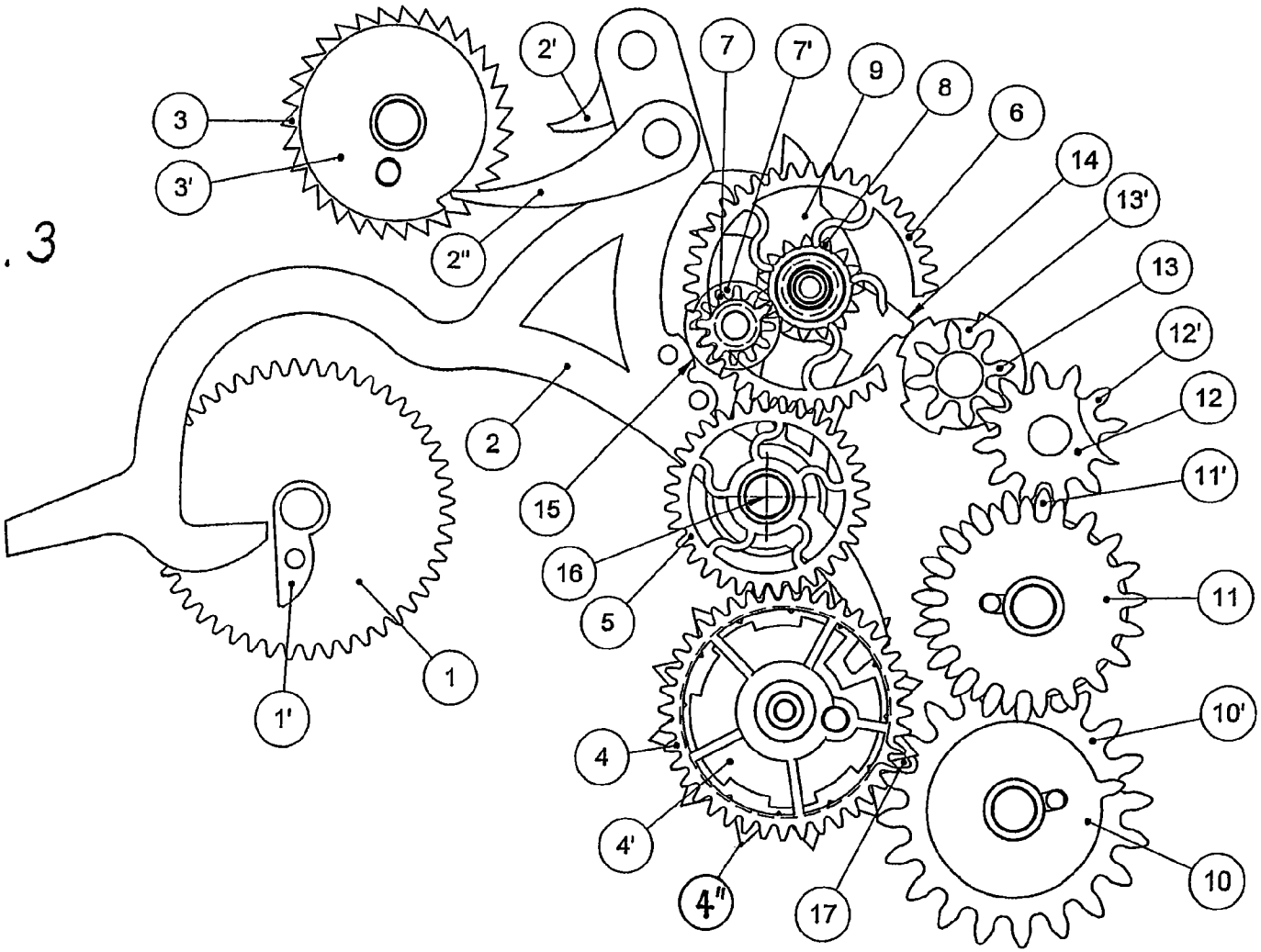
Figure 4:
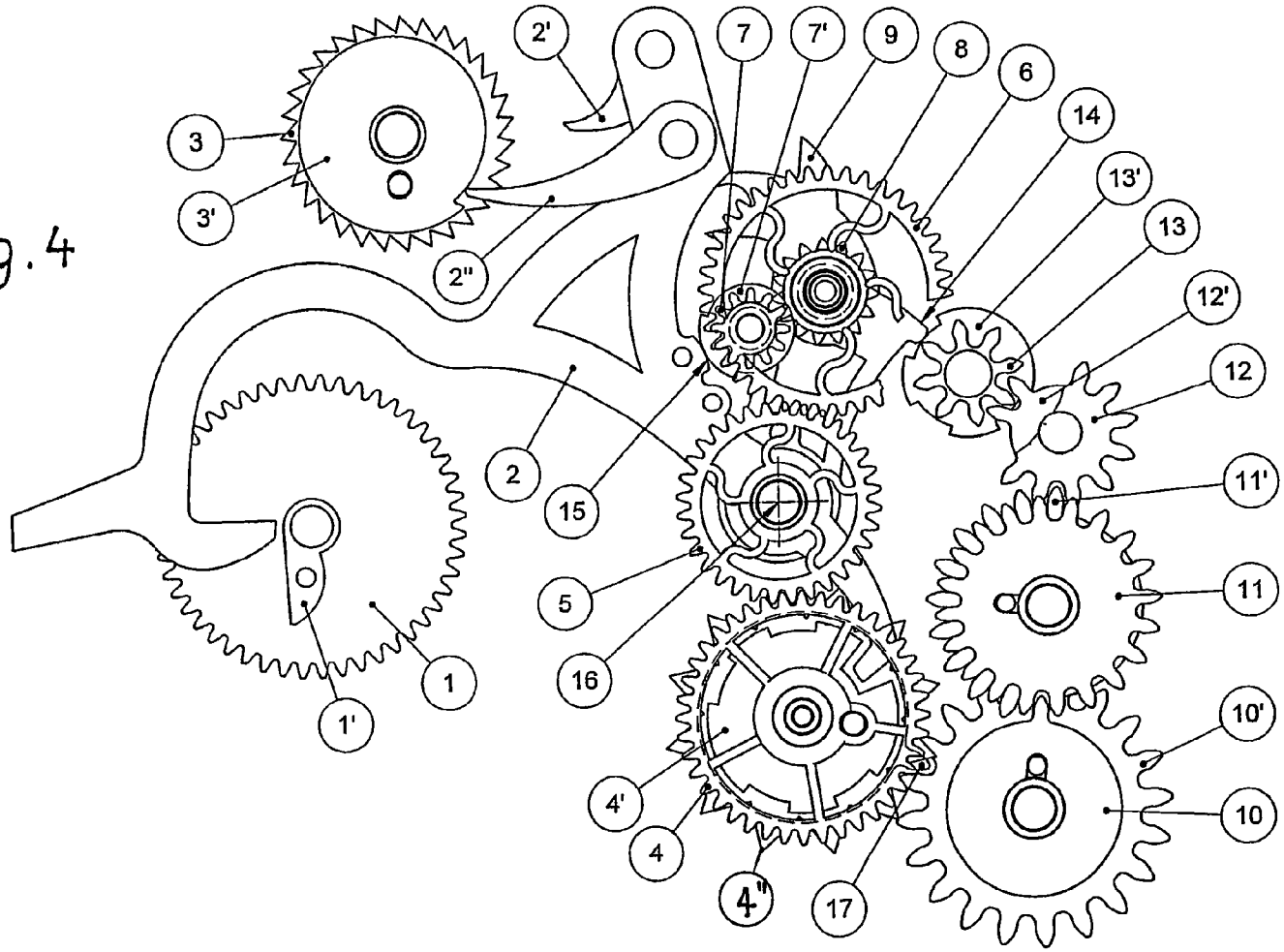
Figure 5:
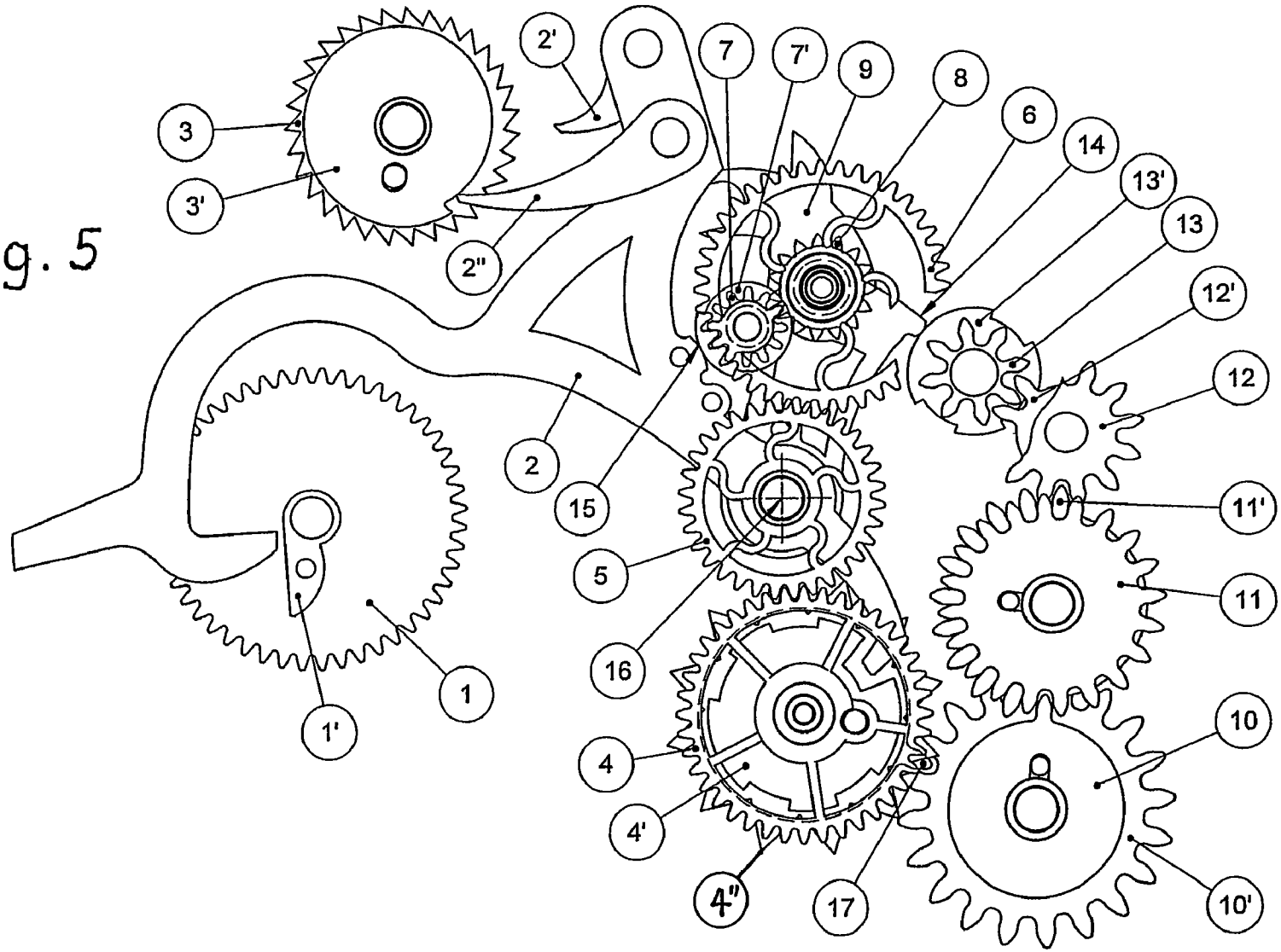
Figure 6:
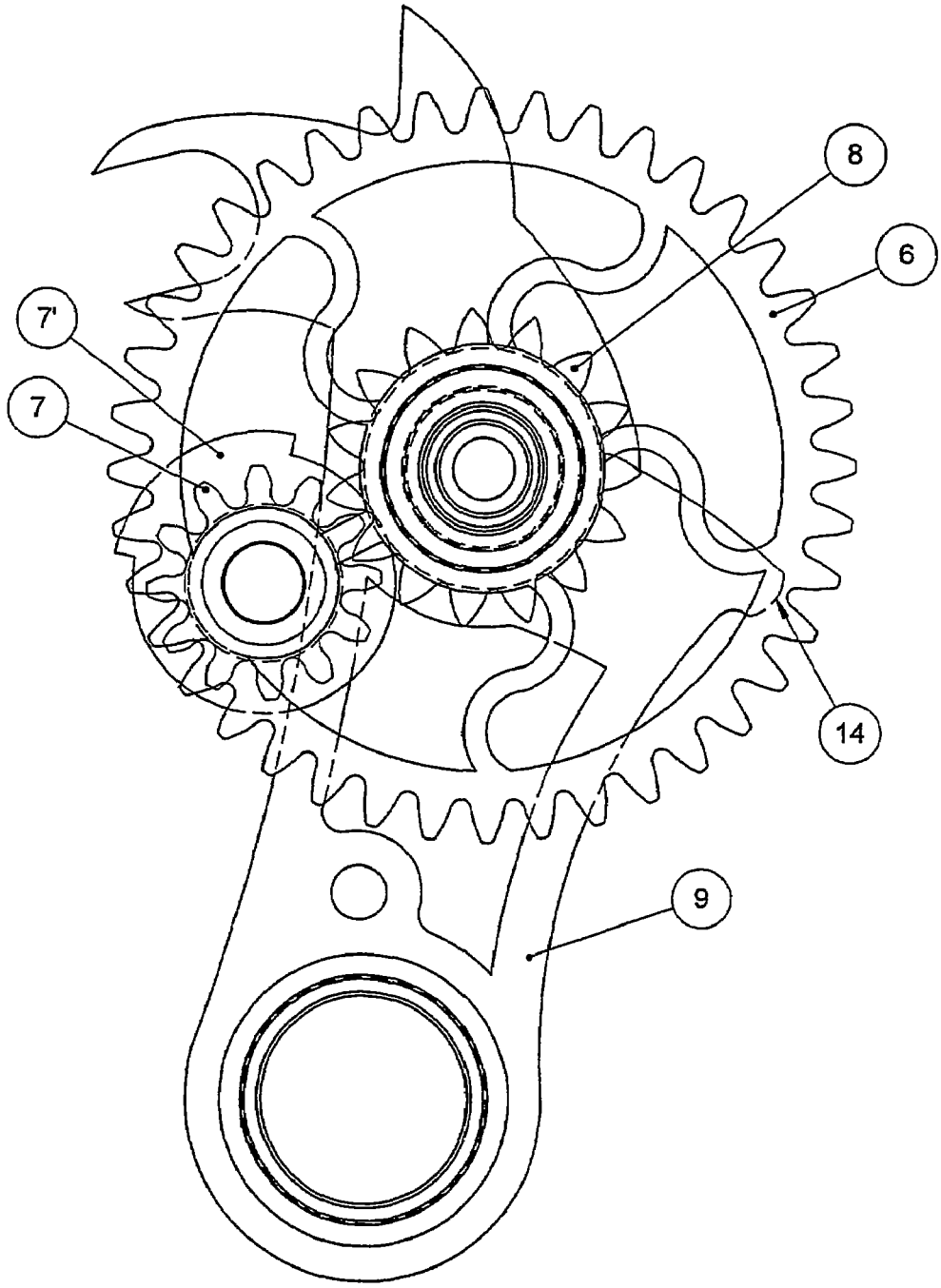
Figure 8:
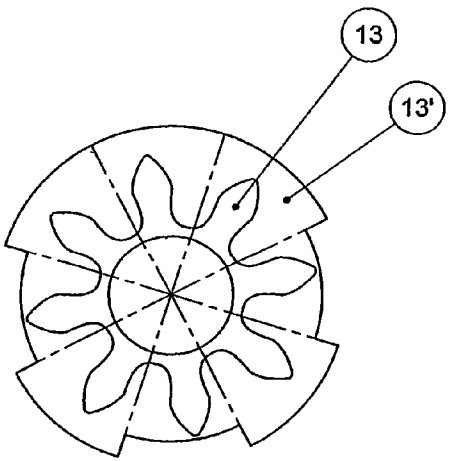
Figure 7:
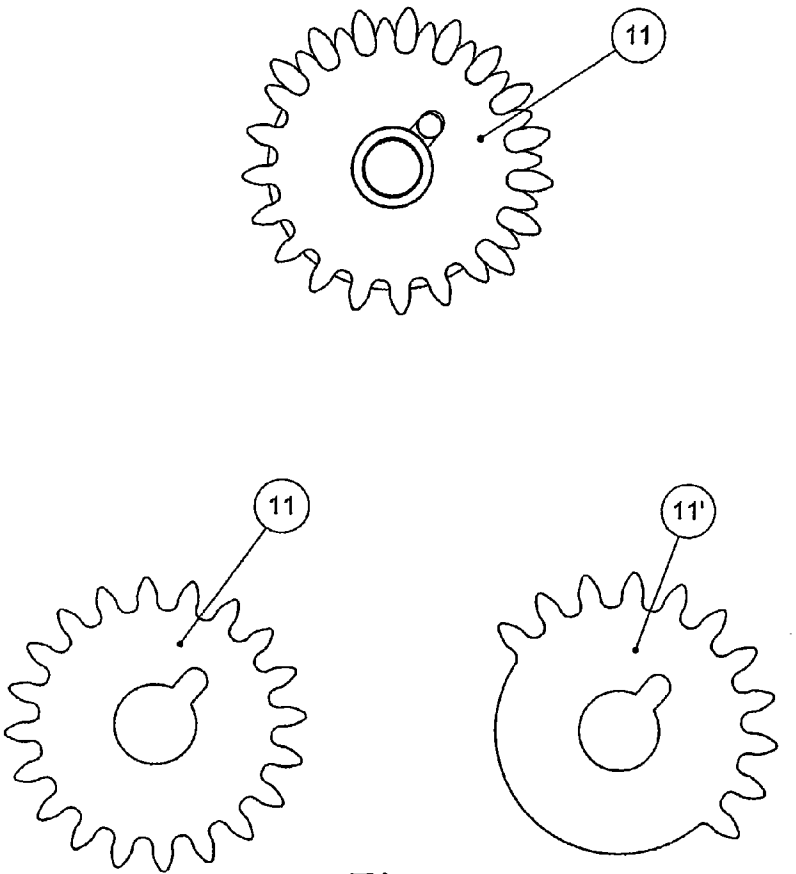

In the drawing:

FIG. 1 is a view of the various gear trains of the secular perpetual calendar according to the invention, FIG. 2 is a view of the secular perpetual calendar similar to that in FIG. 1, but with the gear trains in the position corresponding to the standard $28^{th}$ of February, FIG. 3 is a view of the secular perpetual calendar similar to that in FIG. 1, but with the gear trains in the position of the standard $29^{th}$ of February, FIG. 4 is a view of the calendar in the position corresponding to the $28^{th}$ of February in the last year of the century, FIG. 5 is a view of the calendar in the position of the $29^{th}$ of February in the last year of the century, FIG. 6 is a view of the gear train (6) with its satellite (7), the whole assembly being mounted on the lever (7) pivoting on the axis (16), FIG. 7 is a view of the assembly of the gear trains (11, 11'), and FIG. 8 is a view of the wheel (13) with its cam (13').

The correction made every four years by a conventional perpetual calendar is too great according to the Gregorian calendar and the secular perpetual calendar according to the drawing is designed to maintain the leap year every four hundred years, that is to say each century of which the first two figures are divisible by four, in other words the year 2000, 2400, 2800, etc.

Thus, on each intermediate century, 2100, 2200, 2300 and 2500, 2600, 2700, etc., the leap year is eliminated.

The secular perpetual calendar represented in the drawing comprises a series of gear trains and cams (4, 5, 6, 7, 7', 8, 9, 10, 11, 11', 12, 12', 13, 13', 14), a feeler (2) pivoting around the axis (16) and controlled by the date wheel (3) and its cam (3') and the 24-hour wheel (1) and its cam (1').

It is based on a conventional perpetual calendar in which, in a cycle of 4 years, 3 consecutive years with a 28-day month of February and a 29-day month of February once every 4 years are taken into account.

Starting from this basis, we have a gear train of which the last 8-tooth wheel (13) completes one revolution in four hundred years. This last wheel (13) carries a circular cam (13') with 3 notches each having a value of one eighth of a turn (see FIG. 8).

Position 2: February in the Last Year of a Century (FIG. 4)

The feeler (15) of the multiple lever (2) bears on the leap year step of the satellite cam (7'). To modify the $29^{th}$ of February to 28 days (2100, 2200 and 2300, etc.), the cam (13') is positioned so that the feeler (14) bears on a notch obliging the lever (9) to move back by the value of one step (29-28).

It is important that the cam (13') returns before the following February to a position presenting the largest diameter to display the $29^{th}$ of February in the normal four-year cycle.

To summarise, the small steps of the cam (13') will present themselves to the feeler (14) only for 28 days or more but less than 11 months per century three times in succession.

Explanation of Leap Year Gear Trains

The wheel (4), which is the month wheel, completes one revolution with the cam (4') and the star (4") in one year. The cam (4') presents a very deep February step (in excess of its useful value). This star (4") is attached to the wheel (4) designed to drive the setting wheel (5).

The latter drives the wheel (6) which has the same number of teeth as the wheel (4) and therefore completes one revolution in one year.

On the axis of this wheel, the fixed pinion (8) is attached to the lever (9) which pivots in (16).

The pinion (7) is adjusted freely on one arm of the wheel (6) and is thus positioned as a satellite around the pinion (8) with a gear ratio which causes it make one quarter turn per year.

On the latter is attached a satellite cam (7') of which one quarter of the circumference has a greater diameter for 29-day months. Each year, the cam presents a deviation of 90° with respect to a set point on which the multiple lever (2) will bear for the whole duration of the month of February. They end-of-month adjustment system is conventional. A ratchet for the date and an auxiliary end-of-month ratchet.

Secular Gear Train:

The star (4'') is the month star. It advances by one twelfth of a turn each month, and therefore one turn in one year. On this wheel is attached the month cam (4') with 12 steps of different depths to adjust the irregular end-of-month lengths (conventional system).

On the star (4'') is attached a disk carrying a pin (17). On the transition from the $31^{st}$ of January to the $1^{st}$ of February, this pin drives a tooth of the wheel (10). It remains engaged between two teeth (on the centre line).

On the $28^{th}$ and $29^{th}$ of February, at midnight, by advancing by one tooth, the pin (17) drives a second tooth of the wheel (10) and comes out of its perimeter and the cycle starts again on the following $31^{st}$ of January. The wheel (10) which has 20 teeth will therefore make one revolution in 10 years.

The driving of the wheel (11) is identical in its principle. That is to say it has 20 teeth and every 10 years advances by 2 teeth, driven by a pin attached on the wheel (10). It will therefore make one revolution in 100 years.

The wheel (12) has 12 teeth. It is driven by an 11-tooth sector (11'), attached on the wheel (11) which will drive 2 teeth 6 times in succession, therefore one complete revolution in 60 years, and remain immobile for 40 years until a new tooth of the sector presents itself. It will therefore make one revolution in 100 years.

On the wheel (12) is fixed a double pin (12') which will drive two consecutive times, at an interval of one month, every 100 years, the wheel (13) which has 8 teeth and therefore makes one revolution in 400 years (see FIG. 1). This wheel carries the cam (13') (see FIG. 4 explaining the position corresponding to the $28^{th}$ of February in the last year of a century) which cooperates with the nose (14) of the lever (9).

With the exception of centenary years, the nose (14) of the lever (9) always bears on the high step of the cam (13'). In centenary years, the cam on the $1^{st}$ of February presents a low step to the nose (14) three times in succession, obliging the lever (9) to move back so as to turn the $29^{th}$ of February into the $28^{th}$ for the years 2100, 2200 and 2300. The fourth time, i.e. for the year 2400, the cam presents a high step so as to restore the leap year (see FIG. 1).

The function of the double pin of the wheel (12) is to restore a high step for the next 99 years during the centenary year by causing the cam (13') to make one eighth of a turn, in order to return to the normal leap year cycle.

The invention claimed is:

1. A secular perpetual calendar for timepieces comprising:

a perpetual calendar mechanism; and a centenary mechanism integrated into the perpetual calendar mechanism, the centenary mechanism comprising:

a last wheel making one revolution in 400 years, the last wheel carrying a first cam having a first set of cam steps; and a first lever cooperating with the first set of cam steps, a first wheel pivoting on the lever and carrying a satellite, with a February cam of the perpetual calendar mechanism attached to the satellite, wherein the first cam makes one quarter turn every century, and successively presents three low steps of the first set of cam steps, which enable the first lever to move back in such a way that the February cam, on which a second multiple lever will press, is in the same position as for a conventional 28-day month of February, and the first cam presenting a high step of the first set of cam steps to restore the $29^{th}$ of February; and a double pin, which functions to restore, after the month of February of a centenary year, the normal rhythm of the perpetual calendar mechanism for a further 99 years, by causing the last wheel, and therefore the first cam, to advance by one eighth of a turn.

2. The secular perpetual calendar according to claim 1, wherein the first lever comprises a feeler operative to press on the first cam in such a way as to modify its angular position and, thereby, during each month of February, depending on whether or not the year is the last year of the century, the number of days in the month is in accordance with the position of the first cam.

* * * * *

UNITED STATES PATENT AND TRADEMARK OFFICE

CERTIFICATE OF CORRECTION

PATENT NO. : 7,480,211 B2
APPLICATION NO. : 11/674725
DATED : January 20, 2009
INVENTOR(S) : Pierre-Michel Golay It is certified that error appears in the above-identified patent and that said Letters Patent is hereby corrected as shown below:

On the title page item (73), should read: Franck Müller Watchland S.A. (CH)

Signed and Sealed this

Fourteenth Day of April, 2009

JOHN DOLL
*Acting Director of the United States Patent and Trademark Office*